US005675958A

United States Patent [19]

Shanklin et al.

[11] Patent Number: 5,675,958

[45] Date of Patent: Oct. 14, 1997

[54] SEAL JAW OPERATING MECHANISM

[75] Inventors: Frank Garrett Shanklin, Groton, Mass.; Robin G. Thurgood, Hampstead; Mitchell W. Smith, Newton, both of N.H.; Edward R. Lawson, Methuen, Mass.

[73] Assignees: Shanklin Corporation; Frank G. Shanklin, Ayer, Mass.

[21] Appl. No.: 718,619

[22] Filed: Sep. 6, 1996

Related U.S. Application Data

[63] Continuation of Ser. No. 519,126, Aug. 24, 1995, abandoned.

[51] Int. Cl.[6] ..... B65B 51/10

[52] U.S. Cl. ..... 53/374.6; 53/504; 53/550

[58] Field of Search ..... 53/75, 550, 553, 53/374.6, 371.6, 136.4, 504; 493/478, 475, 34, 10, 13, 14, 15

[56] References Cited

U.S. PATENT DOCUMENTS

| | | | |
|---|---|---|---|
| 3,708,951 | 1/1973 | Folk et al. | 53/75 |
| 3,721,801 | 3/1973 | Bates | 53/550 |
| 4,313,288 | 2/1982 | Tassi et al. | 53/553 |
| 4,317,319 | 3/1982 | Price | 53/76 |
| 4,432,187 | 2/1984 | Elsner et al. | 53/553 |
| 4,783,950 | 11/1988 | Santagati | 53/75 |
| 5,329,745 | 7/1994 | Suga | 53/75 |

FOREIGN PATENT DOCUMENTS

| | | | |
|---|---|---|---|
| 2637154 | 2/1978 | Germany | 53/75 |

*Primary Examiner*—Linda Johnson
*Assistant Examiner*—John Paradiso
*Attorney, Agent, or Firm*—Barlow & Barlow Ltd.

[57] ABSTRACT

An operating mechanism for the seal jaw in a package wrapping machine has an operating arm with means along its length to alter the length of the arm between two finite positions. The arrangement is such that the operating arm for the sealing jaw in the package wrapping machine can be controlled so that it can open to a higher position for large packages and yet also open to a shorter position for less high packages, thus, speeding up the operation of the machine so that it can accept a greater number of packages for any given length of time.

3 Claims, 4 Drawing Sheets

JAW CONN. ROD
OPENING POSITION

JAW CONN. ROD
CLOSED POSITION

SEAL JAW OPERATING MECHANISM

This is a continuation of application Ser. No. 08/519,126, filed Aug. 24, 1995, abandoned.

BACKGROUND OF THE INVENTION

There are many situations in industry where it is necessary to pack or envelope in plastic film products of different sizes. For example, a pharmaceutical supply house will take orders for various drug stores and place them in a corrugated tray. The tray then has to be sealed for delivery and the mount of material in the tray depends upon what has been ordered by the drug store. Mother commonly encountered application where there are random size products is with the magazine distribution centers where the publications are wrapped for delivery to news dealers that order vastly different quantities of magazines. Similarly, groups of magazines that go to different zip codes will have different sized packages. In cases such as this, one of the characteristics of the products that go to the wrapping machine is that some products will be in high stacks and some products will be in low stacks. Imagine, for example, a wrapping machine wrapping a group of high stacks, then all of a sudden a bunch of low stacks arrive. When this occurs, the rate at which the low stacks can be wrapped is limited to the speed for the high stacks where the sealing jaw is traveling such a distance to clear the high stack that there is a finite time for that travel to take place. The wrapping speed would be higher if a lower seal jaw travel could be achieved. It would be desirable, therefore, to have the seal jaw normally open to a lower height but if a grouping of products to be wrapped exceed that height, the seal jaw could now open to a higher limit and the conveyor feeding the higher product could be automatically slowed down as required to permit the longer seal jaw travel.

SUMMARY OF THE INVENTION

To solve the problem of various sized packages, the seal jaw opening is set for a lower limit so that a short seal stroke enables the packaging machine to run rapidly with the conveyor speeds being adjusted accordingly for high speed operation. When products will not fit through the lower jaw opening, they are sensed by a sensor, which actuates a control so that the seal jaw extends to a much higher height to produce a higher opening and also the conveyor slows down to permit the machine to operate properly with the longest stroke of the seal jaw. To accomplish the result, there is built into the jaw linkage an extensible section in the form of an air cylinder. Under normal operation, the air cylinder is retracted so that the jaw operates in its lower position. When an electric eye spaced above the conveyor feeding the seal jaw sensing the height of products sees a product that is taller, the beam will be interrupted and a signal will be sent to air valves feeding an air cylinder in the seal jaw operating linkage causing the air cylinder to extend its piston and increase the height of the operating rod that is connected to the seal jaw. This, then, permits the tall product to pass through the seal jaw. In addition, the product conveyor can be slowed down to provide the time for the higher operation of the seal jaw.

BRIEF DESCRIPTION OF THE DRAWINGS

The novel features which are characteristic of the present invention are set forth in the appended claims. However, the inventions preferred embodiments, together with further objects and attendant advantages, will be best understood by reference to the following detailed description taken in connection with the accompanying drawings in which:

DETAILED DESCRIPTION OF THE PREFERRED EMBODIMENT

Figure 1:
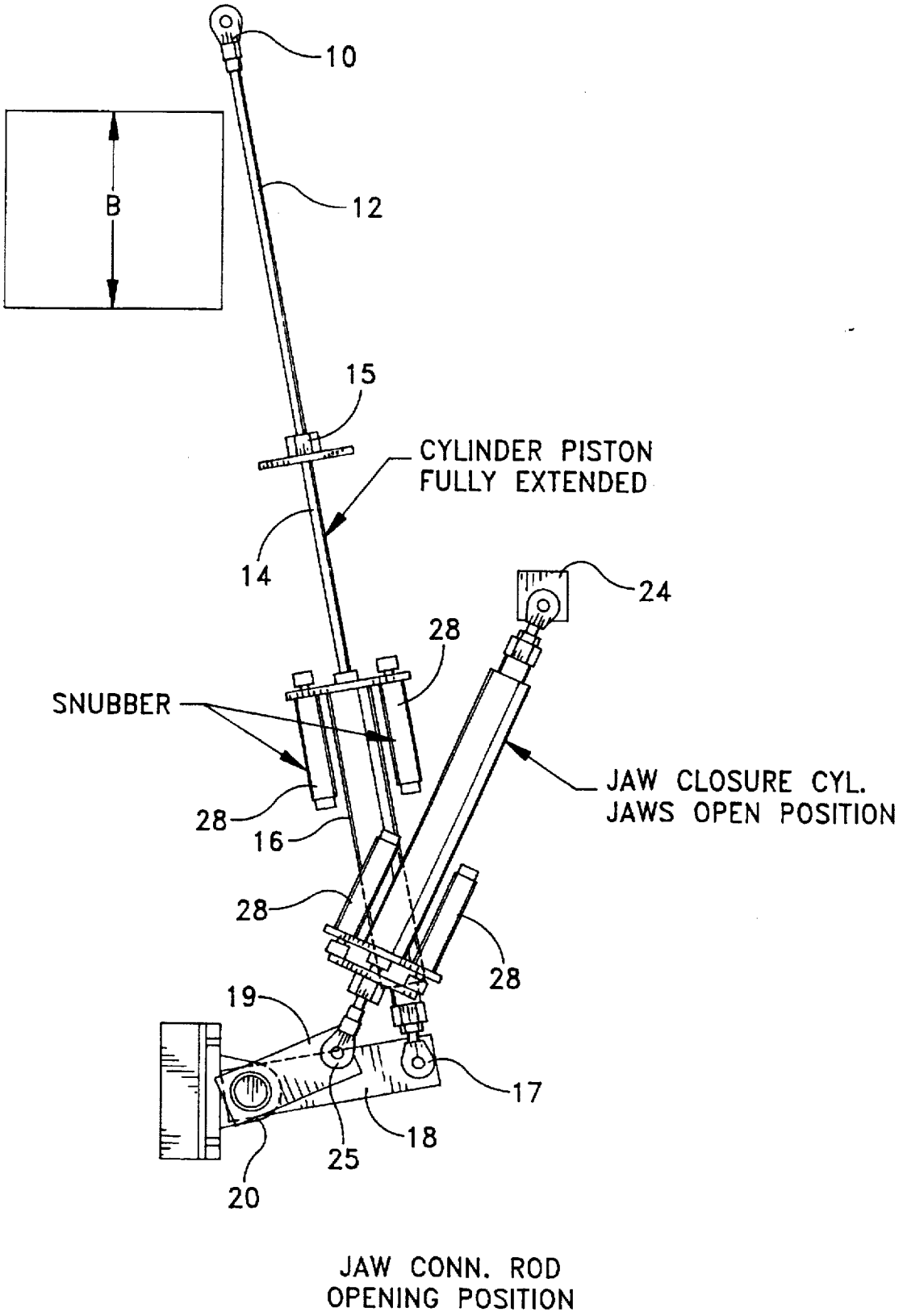
FIGS. 1, 2, 3 and 4 are diagrammatic views illustrating the manner in which the apparatus of this invention operates.

In U.S. Pat. Nos. 4,537,016 and 5,131,213, there is illustrated a sealing jaw 41 of the general type that is utilized with the instant invention. With reference to the drawings, 10 diagrammatically designates the connection to an operating rod 12 to each end of such a sealing jaw the other end of the operating rod 12 is connected to the upper end of a piston rod 14 as at connector 15. The piston rod 14 is operated from a piston cylinder 16 suitably fed by compressed air (not shown) by means well known to those skilled in the art. The cylinder 16 in turn is rotationally connected as at 17 to a crank arm 18 pivoted to a stationary support as at 20 and connected to the second part of crank arm 19. The crank arm 19 is connected to an operating pneumatic cylinder 22 which is supported on a stationary support as at 24 and connected to the portion 19 of the crank arm as at 25. The pneumatic cylinder 22 is illustrated for sake of convenience, although other operating mechanisms such as a coupling to an eccentric drive, would be mechanically equivalent. Electric eye 30 is so positioned that it senses when products are too high to pass under the seal jaw in its low setting as in FIG. 2. Eye 30 signals a controller 31 and the controller signals air valve 32 to extend piston 14 which raises the jaw to the position as seen in FIG. 1 and the controller also changes the speed setting of motor 34 and in turn the product conveyor, to a slower setting. Snubbers 28 cushion the closing stroke of both cylinders, permitting the jaw to be closed rapidly.

Figure 2:
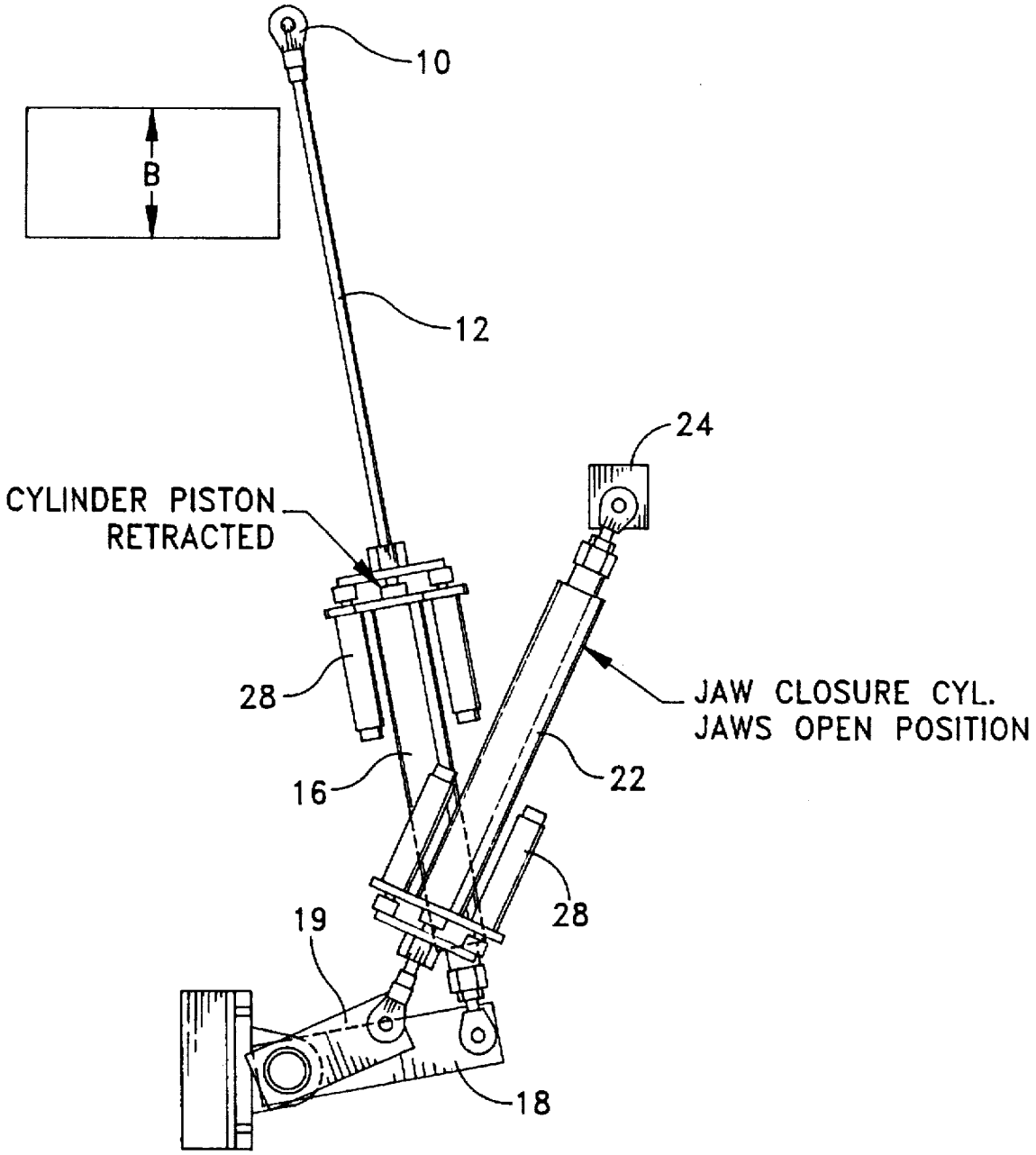
Figure 3:
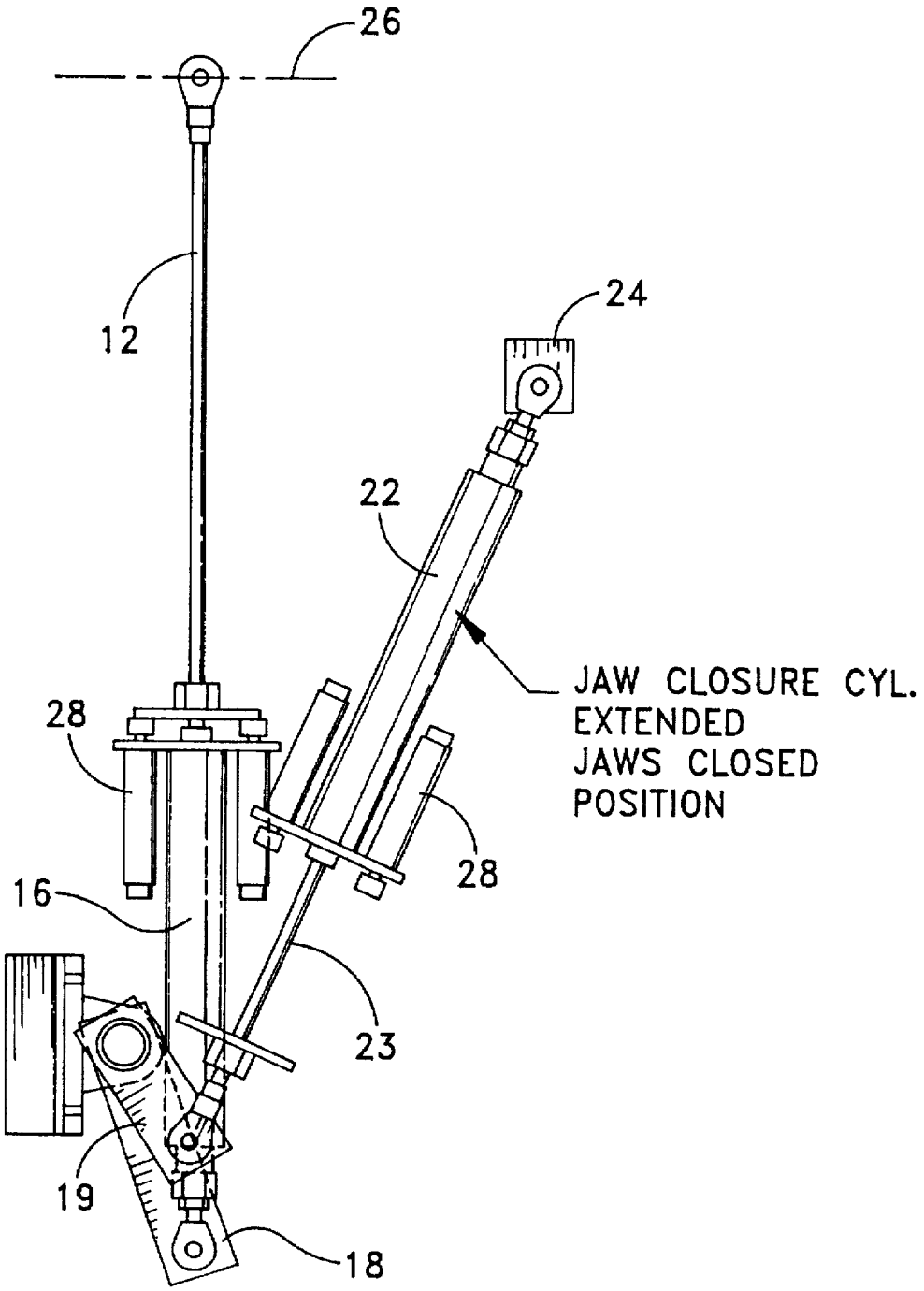
Figure 4:
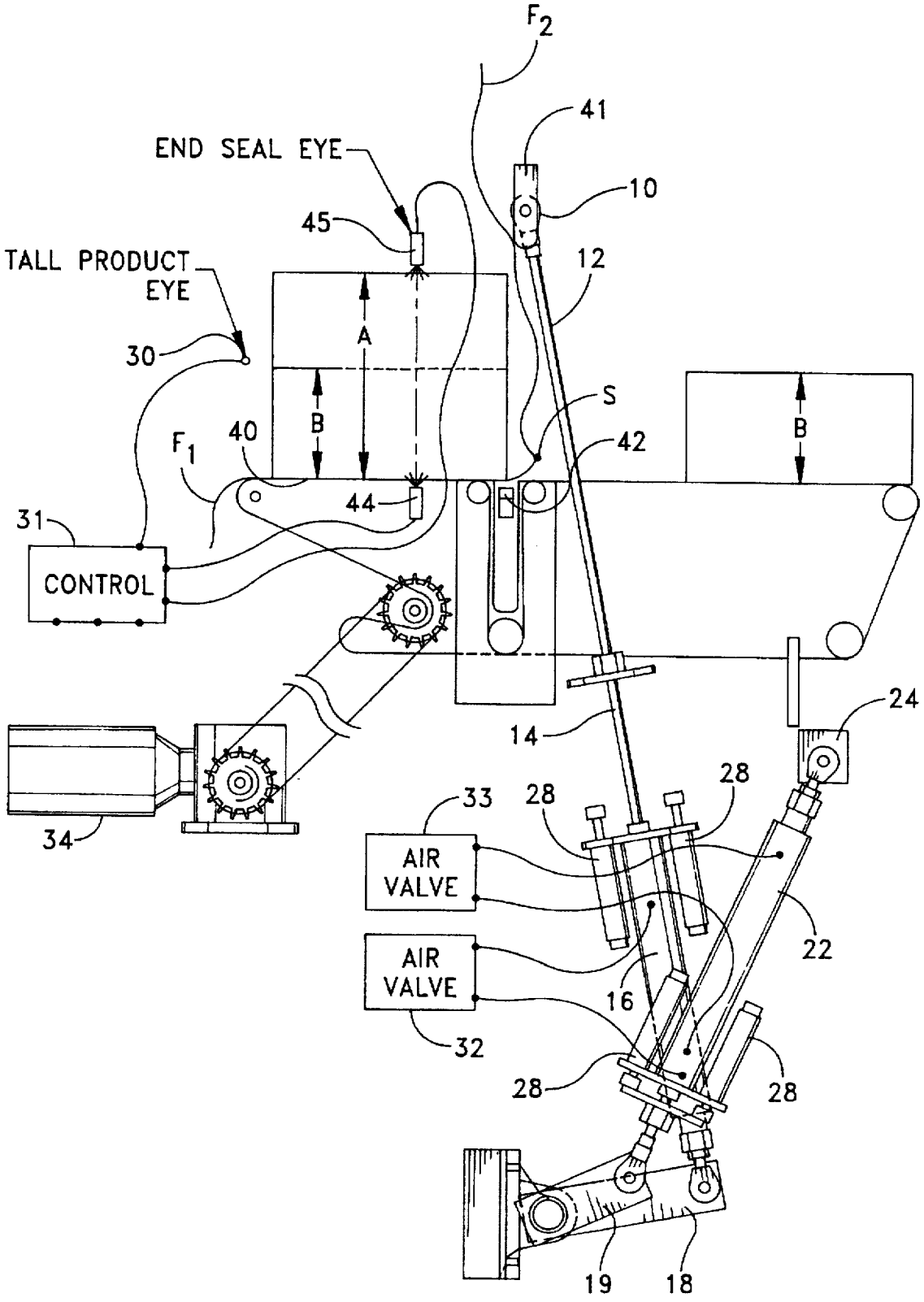

In FIGS. 1 and 4, the apparatus is illustrated as being adapted to accept a high object of a height A and in this condition, the piston rod 14, forming part of the extensible means, is extended. When a signal is received to seal the plastic film $F_1$, $F_2$, control 31 causes air valve 32 to operate to cause piston rod 14 to retract to a position as seen in FIG. 2. After a time delay sufficient to ensure that piston 14 will be fully retracted control 31 causes air valve 33 to operate to feed air to crank arm operating cylinder 22 so that its piston rod 23 (see FIG. 3) is extended which in turn draws down the sealing jaw into sealing position as at 26. After the seal is completed, air valve 33 will operate to retract the piston into cylinder 22, opening the sealing jaw for the next product. If the next product is at a height B or less as seen in FIG. 2, the piston rod 14 will remain retracted and only the closure cylinder 22 will need to be operated to complete a seal. If the next product is above height B, however, eye 30 will also signal air valve 32 to extend piston rod 14 to open the jaw for the high package. From the above description it will be seen that this particular operation for a sealing jaw allows both high and low profile product to be run.

Referring now to FIG. 4 of the drawings, further detail of the apparatus is illustrated in diagrammatic form. It should be noted that the cylinder, piston, cranks etc. are located at both ends of the seal jaw 41. The line 40 represents the top surface of a suitable belt conveyor and a sealing bed is represented at 42, against which a sealing jaw 41 such as seen in U.S. Pat. No. 5,131,213, may operate. A typical sequence of operations must start with the understanding that a leading edge seal S has already been made in the webs of thermoplastic film $F_1$, $F_2$ and a new product is being fed to the machine. Now if a tail product A is sensed by the light beam and electric eye at 30, a signal is sent to controller 31 that in turn signals drive motor 34 for the conveyor to slow. Also, a signal is sent to air valve control 32 that operates cylinder 16, raising the sealing jaw by extending piston rod 14 and operating rod 12. Product A may now pass, crossing end seal light and eye 45, which signals the controller to close the sealing jaw. After an appropriate delay to permit product A to pass through the seal jaws, control 31 signals air valve 32 to close cylinder 16 retracting piston rod 14. After a time delay sufficient to ensure that the piston 14 will be fully retracted before crank arm cylinder 22 completes its travel, control 31 signals air valve 33 to open cylinder 22 extending its piston rod which operates cranks 19 and 18 to close the seal jaw. This sequential operation of the cylinders ensures a uniform closing velocity to prevent the upper jaw from pounding that lower jaw as it closes. Snubbers 28 on both cylinders prevent the jaw from slamming. Following completion of the end seal, the piston 14 will remain in its closed position and the conveyor motor will return to its faster speed as long as only a low profile product B is detected. If, however, another high product such as A is detected, piston 14 will extend and the motor will remain in its slower speed operation.

There is a further advantage to this particular mechanical arrangement that occurs during the jaw opening. A product will normally not enter the seal jaw area until the jaws are fully opened which can be controlled by the use of electric eyes. Now, if the next product is a high product, the jaws will have to be opened to the high position as seen in FIG. 1. The controls are ideally set so that if a high product is seen, then not only does the cylinder 22 raise the jaw but simultaneously, on opening, the cylinder 16 is operated which brings the sealing jaw to the high position much faster than if they are operated sequentially upon the sensing of a high product as, for example a high product of the dimension A. This, then, allows a higher rate of packaging speed. Because of the sequential jaw closing action, and because of the added time required to feed more film around tail products, however, it has been found that as packaging speed increases, it takes more time to wrap higher product than lower product and thus the need for higher and lower speed operation of conveyor motor 34.

It would be appreciated by those skilled in the art that various changes and modifications can be made to the illustrated embodiments without departing from the spirit of the present invention. All such modifications and changes are intended to be covered by the appended claims.

What is claimed is:

1. In a package wrapping machine having means for feeding product into a curtain of plastic film and a reciprocating sealing jaw operable to open for the passage of products into said film and to close for sealing said film between said jaw and a sealing surface, an operating rod means coupled to the seal jaw; said rod having an extensible section means comprising a first cylinder intermediate thereof whereby the rod may be extended or retracted, a second means for reciprocating the rod and said first cylinder;

sensing means to sense the height of product as the product is fed past on the product feeding means, control means responsive to said sensing means to extend said extensible section means when necessary for the seal jaw to clear product, said control means operating said operating rod means and extensible section means simultaneously to produce rapid opening of said seal jaw and operating the operating rod means and the extensible section sequentially for retraction of said jaw to produce a controlled closing velocity of the seal jaw.

2. In a machine as in claim 1, wherein said operating rod means and said extensible section are separate pneumatic cylinders.

3. A package wrapping machine having a conveyor for feeding product, a reciprocating actuator means operating a seal jaw, said actuator means normally establishing a finite height of the seal jaw above the conveyor, a conveyor drive motor, means sensing the height of product on the conveyor, control means responsive to said sensing means, said control means altering the speed of said conveyor drive motor when tall product is sensed, actuator means including serial connected reciprocating means and a first cylinder means for extending and retracting said seal jaw, said serial connected actuator means and cylinder means being simultaneously responsive to said control means for rapidly raising the jaw to pass a tall product, said actuator means and cylinder means acting sequentially so as to initiate jaw closure at a uniform velocity regardless of jaw height.

* * * * *